US006302291B1

(12) United States Patent
McCleerey

(10) Patent No.: US 6,302,291 B1
(45) Date of Patent: Oct. 16, 2001

(54) TRANSPORTING DEVICE FOR BEER KEGS AND PROPANE TANKS

(76) Inventor: Paul McCleerey, 804 Kent Dr., Mechanicsburg, PA (US) 17055

( * ) Notice: Subject to any disclaimer, the term of this patent is extended or adjusted under 35 U.S.C. 154(b) by 0 days.

(21) Appl. No.: 09/538,350

(22) Filed: Mar. 29, 2000

Related U.S. Application Data

(63) Continuation-in-part of application No. 09/268,359, filed on Mar. 15, 1999, now abandoned.

(51) Int. Cl.[7] ..... B65D 25/22; B65D 25/24; B65D 90/12

(52) U.S. Cl. ..... 220/630; 206/501; 206/511; 206/514; 220/771; 220/DIG. 1

(58) Field of Search ..... 220/628, 630, 220/636, 638, 729, 771, DIG. 1; 206/139, 427, 501, 511, 514

(56) References Cited

U.S. PATENT DOCUMENTS

| | | |
|---|---|---|
| D. 367,960 | 3/1996 | Werbesky, Jr. . |
| D. 385,615 | 10/1997 | St. Louis . |
| 4,071,163 | 1/1978 | Martin . |
| 4,398,653 | 8/1983 | Daloisio . |
| 4,899,885 | 2/1990 | Van Koert . |
| 4,907,712 | 3/1990 | Stempin . |
| 5,259,509 | 11/1993 | Boal, Jr. et al. . |
| 5,429,236 | 7/1995 | Evans . |
| 5,513,939 | 5/1996 | Martin et al. . |
| 5,564,568 | 10/1996 | Rankin, Sr. . |
| 5,769,003 | 6/1998 | Rose et al. . |
| 5,799,849 | 9/1998 | Beer et al. . |

*Primary Examiner*—Allan N. Shoap
*Assistant Examiner*—Niki M. Eloshway
(74) *Attorney, Agent, or Firm*—Brian T. Sattizahn; Carmen Santa Maria; McNees, Wallace & Nurick

(57) ABSTRACT

A lightweight shipping device for handling and storing unwieldy, heavy containers such as beer barrels. The device includes a cavity in a stable base that accepts a plurality of popular sizes of beer barrels. The device is made of a lightweight but strong plastic material and includes handles molded into the side to assist in lifting the device when loaded with a barrel. When the device is not needed for storing or lifting a barrel, it can be placed over the barrel. An aperture through the center provides access for a tap, and cupholders along the surface permit the device, when placed over the barrel, to serve as a table.

40 Claims, 10 Drawing Sheets

TRANSPORTING DEVICE FOR BEER KEGS AND PROPANE TANKS

CROSS-REFERENCE TO RELATED APPLICATIONS

This application is a continuation-in-part of application Ser. No. 09/268,359, filed on Mar. 15, 1999, now abandoned.

FIELD OF THE INVENTION

The present invention relates generally to a device for transporting and storing containers, and particularly to stacking and transporting beer kegs and propane tanks.

BACKGROUND OF THE INVENTION

Draft beer is sold by brewers and distributers in kegs of different sizes that contain different quantities of beer. These kegs are frequently sold to individuals for personal use such as at parties and other social functions. The most popular sizes are referred to as quarter kegs and half kegs. Quarter kegs or barrels contain about 31 quarts of beer, while half kegs or barrels contain about 62 quarts of beer. These kegs are difficult to handle because they are unwieldy and heavy and are difficult to transport, frequently being placed in the trunk of a car or in the bed of a pick-up truck. The shape of the kegs is cylindrical, with the height being greater than the diameter. The most stable position is horizontal, however, unless otherwise restrained, the cylindrical shape of the keg causes it to roll.

Various pallets are available for transporting and storing kegs. However, these devices typically are designed to hold a plurality of kegs, and are useful for truckers to transport a plurality of kegs from the brewery to the distributors, but are not of much use to the individual who typically must transport the keg from the distributor or point of sale to his/her home.

One such device, set forth in U.S. Pat. No. 5,769,003 to Rose et al. discloses a twin sheet pallet formed from a pair of thermoplastic material sheets comprising top and bottom platforms with a plurality of four columns projecting from the bottom platform to provide support for the device when loaded with four barrels or kegs. A plurality of parallel ribs provides both a method of joining the platforms as well as rigidity. A series of legs extending down from the bottom surface corresponds with a series of pockets in the top surface to allow the devices to be nested when not in use.

U.S. Pat. No. 5,224,678 to McClellan discloses a stacking and transporting device for a pair of beer kegs. The upper surface includes a pair of saddles for receiving a horizontally-oriented beer keg over a vertically-oriented beer keg. The device also includes apertures through the cylindrical side of the device to permit ready access for beer-dispensing means such as hoses connected to a valve.

Another device set forth in U.S. Pat. No. 4,354,599 to Brown et al. discloses a saddle adapted to hold and restrain a pair of kegs on top of each other. The saddle has a concave bottom portion that rests atop an upright or vertically oriented keg and a top portion that includes a pair of spaced shoulders to support the horizontally oriented keg.

However, none of the prior art devices addresses the problem associated with transporting individual kegs or barrels of beer. What is needed is a lightweight device to facilitate handling of a keg of beer, while also providing the required stability to transport a keg of beer on the bed of a pick-up truck or in the trunk or rear of a vehicle.

Propane is another substance that is typically sold in tanks of different sizes that contain different quantities of propane. These tanks are frequently sold to individuals for personal use in gas grills or for supplying the fuel for gas logs in a home. One of the most popular sizes of propane tanks is a 20 lb. tank which contains approximately 20 pounds of propane fuel. These tanks, like beer kegs, are also difficult to handle and transport because they are unwieldy, heavy and frequently need to be placed in the trunk of a car or in the bed of a pick-up truck for transport. The shape of the tanks is substantially cylindrical, with the height being greater than the diameter. The propane tank is frequently stood upright for transport, however, unless otherwise restrained, the cylindrical shape of the tank causes it tip over and the roll around the car or truck uncontrolled, which can be a potential safety hazard.

Various devices have been developed for the transportation of a single propane tank. However, these devices are either complicated to use, difficult to load with the propane tank or are unstable when loaded with a propane tank. Therefore, what is needed is a lightweight and easy to use device to facilitate handling of a propane tank, while also providing the required stability to transport a propane tank on the bed of a pick-up truck or in the trunk or rear of a vehicle.

SUMMARY OF THE INVENTION

The present invention is directed to a moldable molded shipping device for handling and storing one cylindrical container. Although the device allows for the handling and storing of a single cylindrical container, it also permits the stacking of two or more containers, one on top of the other. The device is comprised of a top surface, a bottom surface, and a intermediate surface positioned between the top and the bottom surfaces. Each of the top surface, the bottom surface and the intermediate surface lie in substantially parallel planes. The handling and storage device includes an outer perimeter that connects the top and bottom surfaces. The outer perimeter is substantially at right angles to the planes that include the top and bottom surfaces. The outer perimeter, although substantially at right angles to the planes that connect the top and bottom surfaces, may vary slightly from 90°. This slight deviation from right angles will assist in the manufacturer of an article when the manufacturing method so requires an angle for ease of moldability and separation from the mold. When the outer perimeter assumes a square shape, the sides are of substantially equal length. When the device is rectangular in shape, the ratio of the long side to the short side is no more than 1.5 to 1. Molded into the outer perimeter are at least two lifting handle indentations, the indentations located in the outer perimeter opposite one another. If the outer perimeter is cylindrical, the handles are approximately diametrically opposed. If the device is roughly square so that the outer perimeter has four sides, the outer perimeter includes at least two handles located on opposite sides. The indentations may extend completely around the perimeter. There is a cavity in the top surface that extends down to the intermediate surface. The cavity is substantially cylindrical in shape and an arcuate surface connects the top surface and the intermediate surface, the arcuate surface forming the circumferential boundary of the cylindrical cavity while the intermediate surface forms the bottom of the cavity. The arcuate surface forming the inner perimeter, the perimeter of the cavity, has a first diameter at the intermediate surface that corresponds to a first diameter of the cylindrical container that the shipping device is designed to accommodate, the device having a first diameter slightly larger than the corresponding diameter of the container. The handling device has a second diameter at the top surface, the second diameter corresponding to a second diameter of the container, the second diameter of the device being larger than the first diameter. Thus, there is a taper in traversing from the top surface to the intermediate surface. The length of any one side of the device must be larger than the second diameter of the device at the top surface to provide optimum stability. If the cylindrical container that is to be handled by the shipping device has a constant diameter along its cylindrical axis, the first diameter and the second diameter of the device will have roughly the same dimensions, the diameters being slightly larger than the diameter of the cylindrical container so that the cylindrical container seats on the intermediate surface while being bounded by the arcuate surface. Usually, however, the shipping device will have a first or lower diameter that is slightly smaller than its diameter at its mid-point, so that there is a taper. In this situation, the arcuate surface will diverge outward in the direction from the intermediate surface to the top surface. Thus, the second diameter at the top surface will correspond to a diameter of the cylindrical container at the appropriate height above the intermediate surface, once again, so that the bottom surface of the cylindrical container rests on the intermediate surface.

An aperture extends between the intermediate surface of the handling and storage container and the bottom surface of the handling and storage container. The aperture in the form of a bore is centered over the first diameter and the second diameter of the shipping device, the center of the first diameter and the second diameter being substantially coaxial. This aperture allows the weight of the device to be reduced, so that the combined weight of the device and the container when filled with fluid can be kept at a minimum without adversely affecting the function of the device to be used for handling and storage. The bore or aperture serves additional purposes as well.

An advantage of the present device is that it stabilizes an unwieldy container during transport, yet is light in weight, providing lifting points or handles to facilitate the lifting of both the device and the container as the container sits within the device. It can be conveniently used to lift a container onto the bed of a pick-up truck or into the trunk of a vehicle, while providing stability to the container as it is being transported to its destination.

Still another advantage of the present device is that it provides sufficient additional stability so that a plurality of containers can be stacked one on top of the other.

A further advantage of the device is that it can incorporate containers that have a range of sizes, so that it can be used to transport and to lift the heavier, most popular sized containers. For beer barrels, the device can be used to transport and store both half barrels and quarter barrels.

Another embodiment of the present invention is directed to a shipping device used for transporting, handling and storing one of a beer keg and propane tank. The shipping device includes a base surface and a substantially cylindrical projection extending from the base surface and which has a central axis. The substantially cylindrical projection includes a top surface disposed opposite the base surface, an inner perimeter and an outer perimeter. Both the inner perimeter and the outer perimeter connect the top surface of the substantially cylindrical projection and the base surface. The inner perimeter includes a first surface, a second surface and a third surface, each surface being coaxial with the central axis of the substantially cylindrical projection.

The first surface of the inner perimeter is an arcuate surface and extends between the top surface of the substantially cylindrical projection and the second surface of the inner perimeter. The first surface of the inner perimeter has a first diameter at the top surface and a second diameter at the second surface of the inner perimeter, the first diameter of the first surface being larger than the second diameter of the first surface. The second surface of the inner perimeter is substantially parallel to the base surface and extends between the first surface and third surface of the inner perimeter. The first surface and the second surface of the inner perimeter are positioned to receive a propane tank or a beer keg. The third surface of the inner perimeter is positioned between the base surface and the second surface of the inner perimeter. The third surface is substantially perpendicular to the base surface and has an elliptical cross-section.

The shipping device also has a plurality of wedge-shaped projections that extend from the base surface and are positioned radially about the axis of the substantially cylindrical projection. Each of the plurality of wedge-shaped projections includes a first end adjacent the third surface of the inner perimeter and a second end positioned opposite the first end and adjacent to the central axis of the substantially cylindrical projection. Each of the plurality of wedge-shaped projection is disposed a distance from the third surface to form a gap between each of the plurality of wedge-shaped projections and the third surface of the inner perimeter. The gap between each of the wedge-shaped projections and the third surface of said inner wall is positioned to receive a base ring of a propane tank.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Whenever possible, the same reference numbers will be used throughout the figures to refer to the same parts or features.

DETAILED DESCRIPTION OF THE INVENTION

Figure 1:
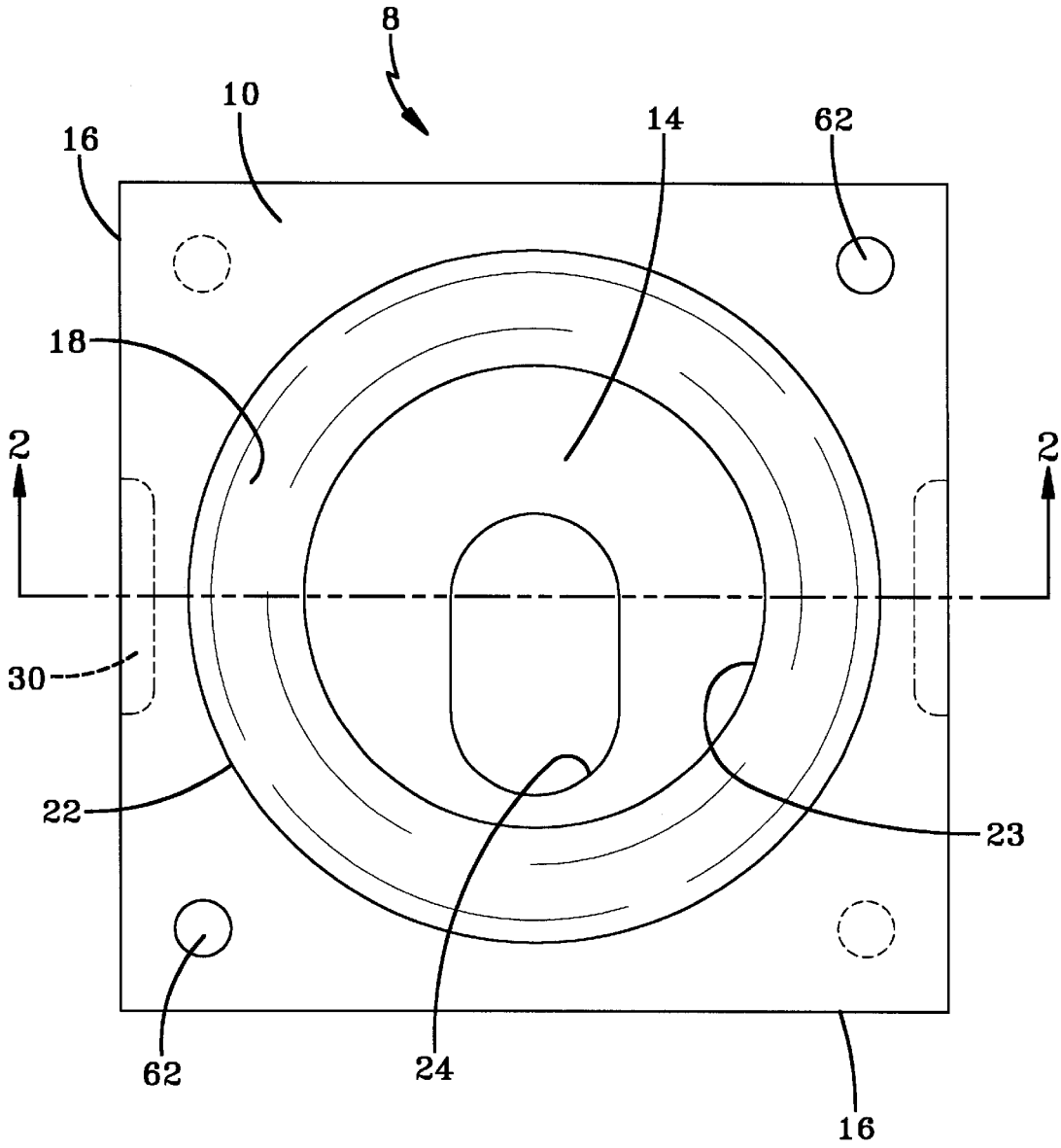
FIG. 1 is a top view of one embodiment of the device of the present invention.
Figure 2:
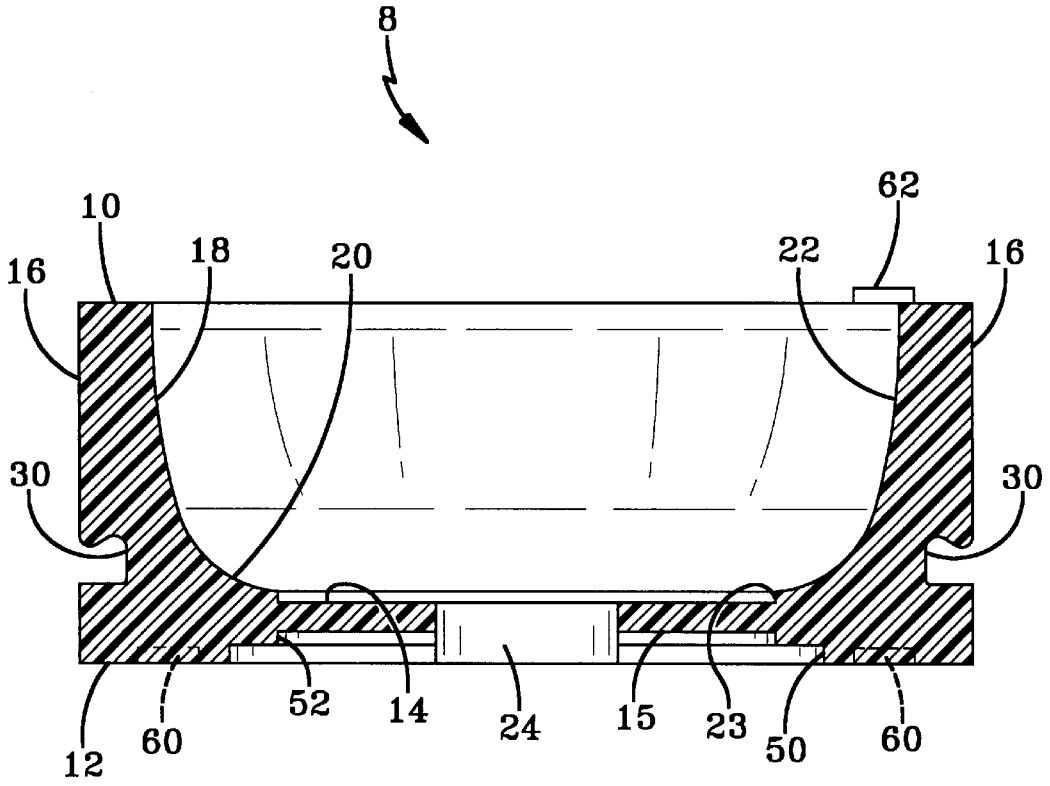
FIG. 2 is a cross-sectional view of the first embodiment of the device of the present invention taken in the direction shown in FIG. 1.
Figure 3:
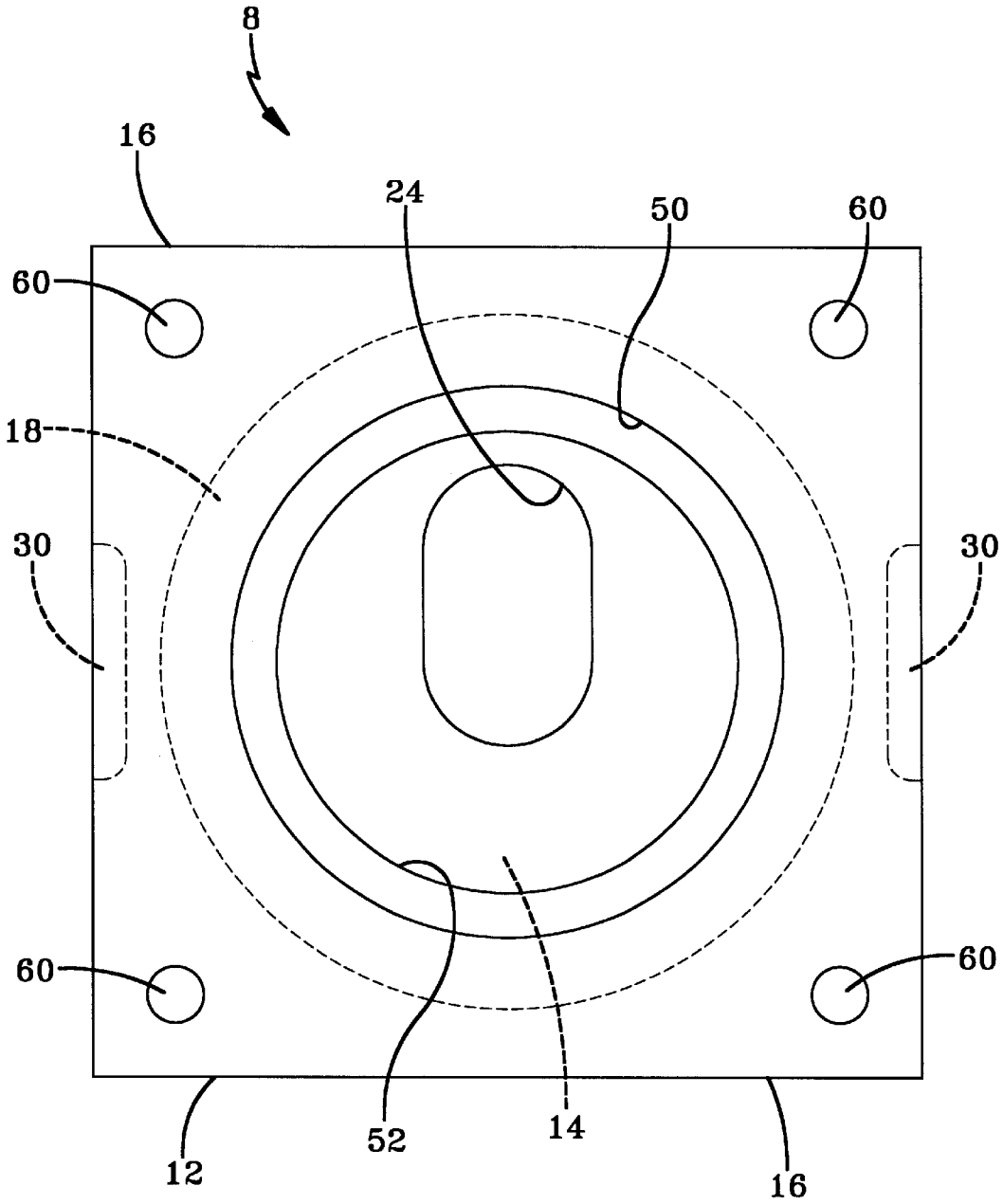
FIG. 3 is a bottom view of the first embodiment of the device.

Referring now to FIGS. 1, 2 and 3 which are illustrations of the top view, a cross-sectional view taken along lines 2—2 of FIG. 1, and a bottom view, of one embodiment of the device 8 of the present invention. The device includes a top surface 10 and a bottom surface 12. An intermediate surface 14 is positioned between top surface 10 and bottom surface 12. The device has an outer perimeter that is substantially rectangular in shape, having four sides 16. In the preferred embodiment the four sides are substantially equal, so that the device is substantially square, the four sides 16 forming the outer perimeter. However, the preferred embodiment forms no limitation on the device, as the outer perimeter may assume any shape, such as an outer cylindrical surface, as will become apparent from the discussion of the invention. This outer perimeter lies approximately at right angles to the planes containing the top and bottom surfaces. However, for manufacturing purposes, the sides may deviate from a right angle by a small amount, up to about 10 degrees, for ease of manufacturing. Such a drafting angle assists in removal from molds when the device is manufactured such as by a molding operation.

An arcuate surface forms a substantially concave surface or inner perimeter 18 between top surface 10 and intermediate surface 14. The inner perimeter 18 forms a concavity which has a first diameter 20 located along the inner perimeter corresponding to a first diameter of a large cylindrical container that is to be held in the device. The device further includes a second diameter 22 that is at least as large as, and preferably slightly larger than, a corresponding second diameter of the container, so that the container sits comfortable within the concavity formed by inner perimeter 18. It will be understood that the inner perimeter 18, because it forms a concavity, includes incremental changes in diameter in traversing the inner perimeter 18 from top surface 10 to intermediate surface 14 forming a taper so that containers of various diameters can be reliably placed in device 8. The device incorporates a third diameter 23 at intermediate surface 14 that is slightly smaller than the diameter of a small container that can be received by the device. Although the transition from inner perimeter 18 to third diameter 23 at intermediate surface 14 is depicted in FIG. 2 as an abrupt change to a constant diameter, it will be understood that this transition may be a smooth continuation of inner perimeter 18, or it may be yet an additional second perimeter (not shown) having a radius different from the radius of the first inner perimeter 18 . While the first inner perimeter 18 can be designed to accommodate a first container, the second perimeter can be designed to accommodate a second, smaller container. In the preferred embodiment, the first inner perimeter 18 is designed to accommodate a barrel of beer referred to as a half keg, while a third diameter 23, or if desired, a second perimeter (not shown) is designed to accommodate a quarter keg or quarter barrel. The first diameter 20, the second diameter 22, the third diameter 23 or second perimeter (not shown) and inner perimeter 18 are coaxial so as to accommodate barrels of various sizes without the need to modify device 8.

The device should be made as light as possible. It would not be desirable for the device to be heavy, since its purpose is to be an aid in moving a full heavy container as well as in providing stability while the container is being transported. The device is desirably manufactured of a lightweight, moldable material such as a thermoplastic. While any molding method may be used, preferably, the device is manufactured from polypropylene, by a process such as injection molding. Most preferably, the polypropylene device is manufactured by blow molding or rotational molding. However, the device need not be so restricted; it may also be constructed from composite materials or even graphite. The major drawbacks to such materials is their cost, such materials being prohibitively expensive at this time and complexity in manufacturing.

The device in an optional embodiment may be hollow. In this embodiment, the device may include at least one removable plug or cap that provides access to the interior while fluidly sealing the interior when inserted. Thus, material such as sand or a fluid can be added to provide additional stability in transit. Of course, a fluid such as water can be added through a plug positioned along top surface 10 and removed from a plug or cap located on a surface positioned along the bottom, such as surface 12 or one of the surfaces through which all or most of the fluid can readily drain, as desired.

If the fluid is cold, it will assist in keeping the barrel cold. Alternatively, a lightweight insulating material such as Styrofoam can be injected into the hollow version to provide an additional insulating capability, if desired.

To assist in handling a device loaded with a heavy container, in the preferred embodiment, two lifting handles can be molded into at least two opposed sides 16. If the device is cylindrical in shape, the handles can be on the outer perimeter, preferably diametrically opposed. The handles may be indentations 30 in at least two sides 16, being formed in opposed sides. The indentations can be molded into hand grips, as shown in FIG. 2. However, the lifting handles may take any form and are not so restricted. The indentations may also extend completely around the outer perimeter.

To further lighten the device, an aperture 24 or bore extends between intermediate surface 14 and bottom surface 12. Aperture 24 may be any shape. In FIGS. 1 and 3, it is in the shape of an oval, but it may be round or any other geometric shape. It includes the axis of inner perimeter 18, first diameter 20, second diameter 22 and third diameter 23 or second perimeter (not shown), so that the center of a container or barrel is over a portion of aperture 24.

Figure 4:
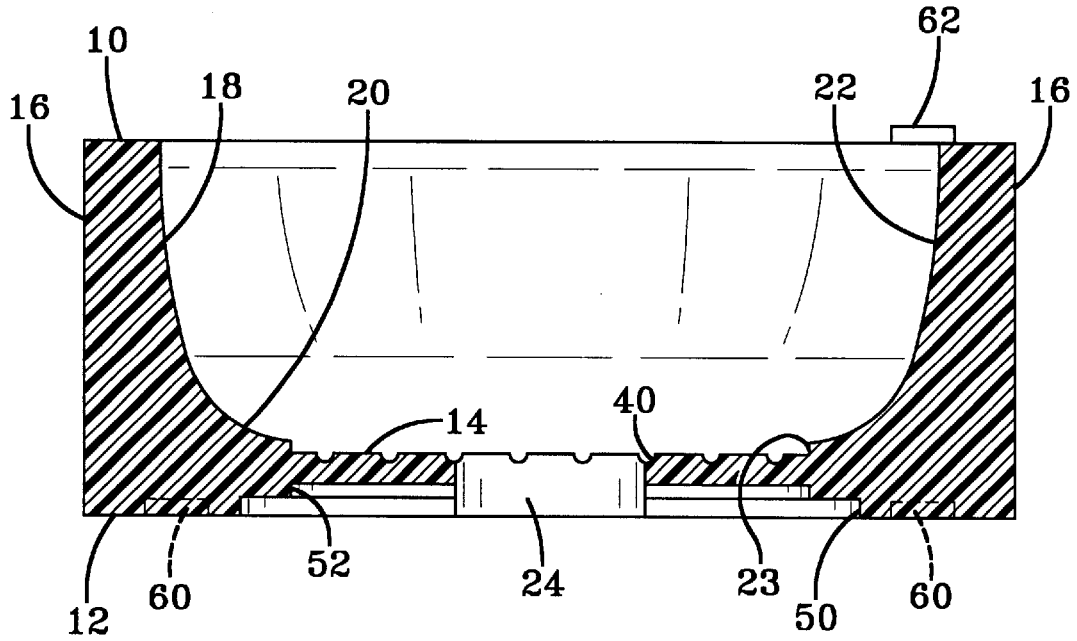
FIG. 4 is a view of a second embodiment of the present invention.

Referring now to FIG. 4, in order to add strength to the device without adding additional weight, a plurality of ribs 40 are molded into intermediate surface 14 in a preferred embodiment of the invention. The general profile of intermediate surface 14 is such that it remains in a plane substantially parallel to the planes that include top and bottom surfaces 10 and 12 respectively; however the ribs, while providing strength, do not interfere with the seating of a small barrel along intermediate surface 14. Ribs (not shown) may also be added along outer perimeter, inner perimeter 18 and bottom surface 12 if desired, in order to add strength and stiffness to the device.

Referring again to FIGS. 1, 2 and 3, bottom surface 12 of the shipping device of the current invention includes a plurality of cylindrical indentations or bores. In a preferred embodiment, the first indentation 50 has a first preselected depth and a first preselected diameter. The first preselected diameter is slightly larger than corresponding diameter of the top of a large barrel of beer. A second indentation 52 has a second preselected diameter and extends to a preselected depth, the second preselected depth being deeper than the first preselected depth, the second preselected depth extending downward to surface 15 on the reverse side of intermediate surface 14 in special relation from bottom surface 12. The second preselected diameter of indentation 52 corresponds to the diameter across the top of a small barrel or keg of beer. This diameter is slightly larger than the corresponding diameter of a small barrel so that the device may be placed over a small barrel, or may be placed over a large barrel, diameter of indentation 50 being slightly larger than a corresponding diameter of a large barrel. Diameter of indentation 52 is slightly larger than the diameter of the top of a small barrel and corresponds to and is approximately equal to diameter 23 at intermediate surface 14.

A second handling device may be placed over a large barrel of beer or a small barrel of beer since indentations 50 and 52 will accommodate the tops of the barrels. For storage purposes, a second large barrel of beer then can be placed in the second shipping device, which now provides stable storage for the two barrels. Alternatively, a small barrel of beer may be placed over a large barrel of beer, the second device fitting over the barrel of beer so that the device seats over the large barrel of beer at diameter of indentation 50. A small barrel of beer can then be placed within the container so that the small barrel seats on intermediate surface 14 within diameter 23. In a similar fashion, two small barrels of beer may be placed one on top of the other for stable storage using a second device.

The bottom surface also includes a plurality of small cavities 60 as shown in FIGS. 2 and 3. These cavities have diameters sufficiently large to accept cups, and may have a plurality of diameters or have tapered diameters so that various sized cups may fit within the same cup holder. Top surface 10 includes at least two projections 62. These projections 62 are positioned on top surface 12 so that projections 62 correspond to small cavities 60, projections 62 being sized to be received by the corresponding cavities 60 so that the shipping devices may be stacked one on top of another, the projections 62 being received within the small cavities 60 of the device when devices are stacked. In this way, the devices may be stacked in a stable fashion so that they will not readily slide off of one another. This is a suitable arrangement for storing the shipping devices when not in use, or for transporting the devices from one location to another.

Figure 5:
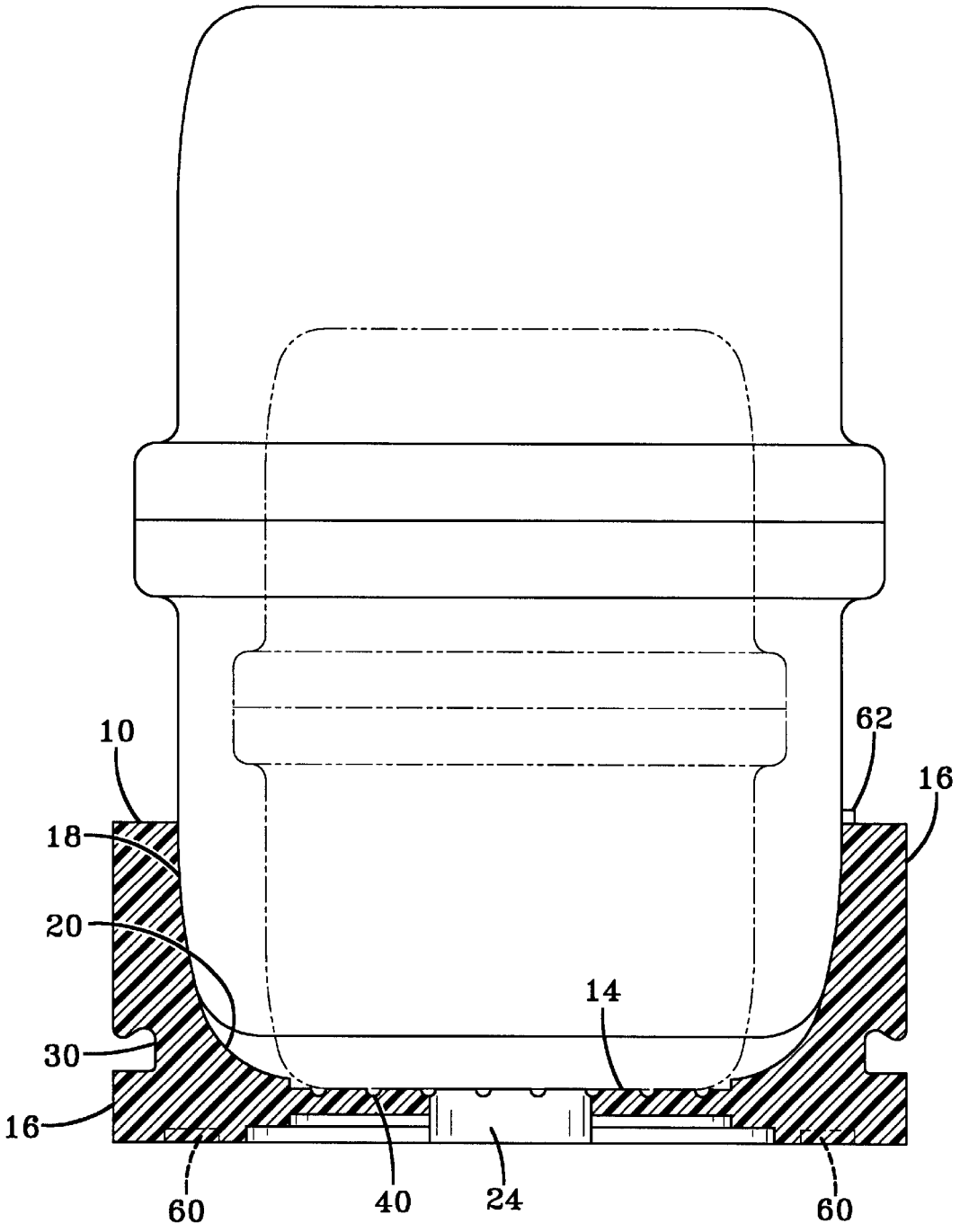
FIG. 5 is a cross-sectional view of the second embodiment of the present invention illustrating the ability of the container to hold different sized containers.

FIG. 5 is a cross sectional view of the present invention showing the invention holding a large barrel of beer and, in phantom view, a small barrel of beer. As shown in FIG. 5, a large barrel of beer fits within inner perimeter and is seated along the device at diameter 20. The small barrel of beer or quarter keg of beer is shown in phantom by the dotted lines in FIG. 5. This small barrel sits further down within device 8 resting on intermediate surface 14 within diameter 23, see FIG. 4, ribs 40 being shown in the preferred embodiment providing strength and stability to the device.

Figure 6:
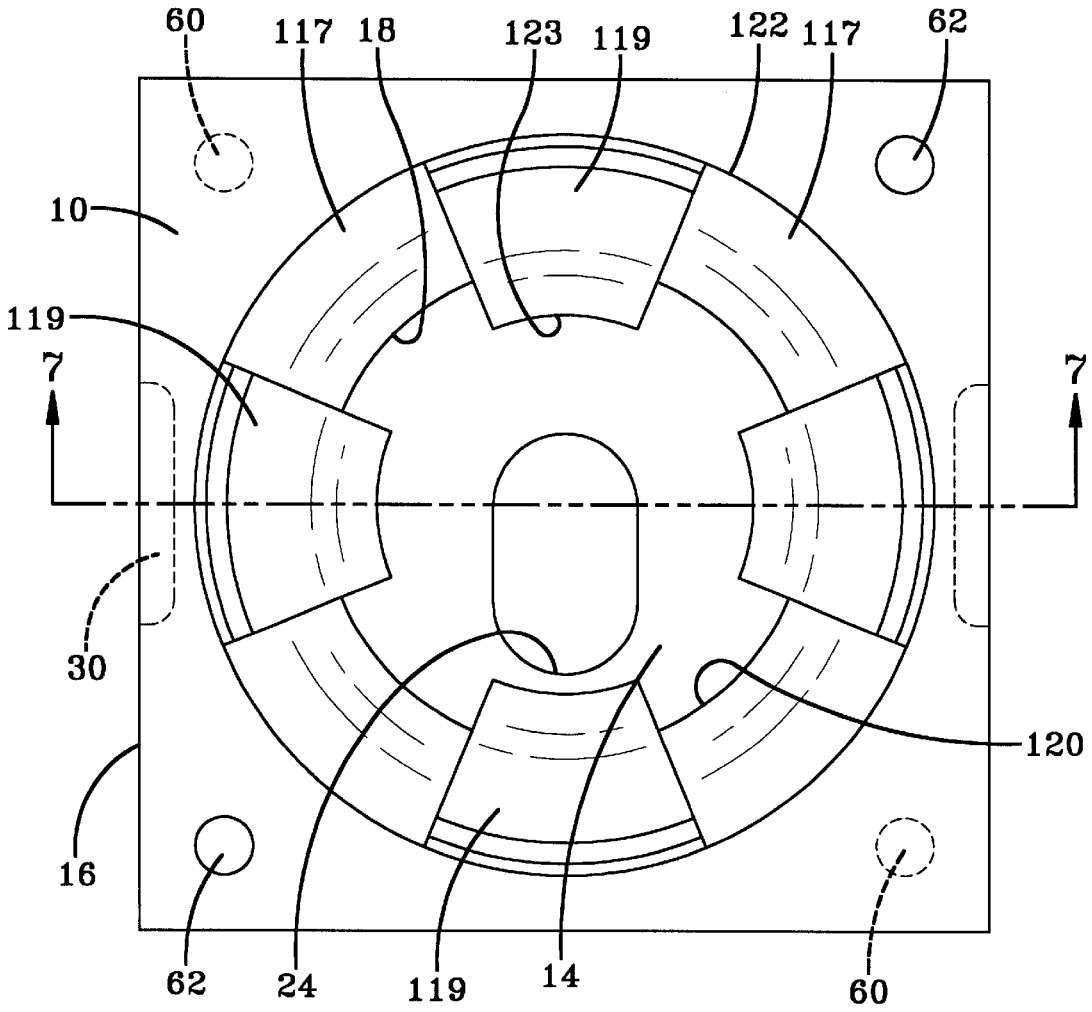
FIG. 6 is a view of a preferred embodiment of the present invention.

FIG. 6 is a top view of a preferred embodiment of the present invention. FIG. 6 shows a preferred embodiment of the present invention. This embodiment is modified slightly from the previous embodiments to provide a lighter weight device as will become evident. In this embodiment, a cylindrical cavity extends from top surface 10 to intermediate surface 14, the inner diameter 122 of this cavity being larger than a container to be held by the device, but smaller than any of the sides 16. Within this cavity are two sets of inserts, a set of upper inserts 117 and a set of lower inserts 119. In the preferred embodiment as shown in FIG. 6, there are four upper inserts 117, and four lower inserts 119. However, it is not necessary to have four upper and lower inserts, as a minimum of two upper inserts and two lower inserts could adequately perform the task. However, additional stability will be provided by at least three upper inserts 117 and three lower inserts 119. Upper inserts 117 have an inner diameter 120 corresponding to the diameter of a container such as a large barrel of beer, diameter 120 being slightly larger than the contained diameter. These inserts extend back to diameter 122 and may extend the entire length of the cavity down to intermediate surface 14. However, these inserts do not have to extend to the entire length of the cavity and may extend only partially down along the surface along the cavity from top surface 10 down toward intermediate surface 14. Inserts 117 need only extend sufficiently far down the cavity to stabilize a container such as a barrel of beer during shipment and storage. Additionally, the spaces between the inserts conveniently permit access to the underside of the barrel to facilitate lifting of the barrel from the device. Lower inserts 119 have an inner diameter 123 corresponding to the inner diameter of a small barrel of beer, inner diameter 123 being slightly larger than the diameter of a small barrel of beer. In a preferred embodiment lower insert 119 is molded integral with intermediate surface 14, and extends upward into the cavity toward the top surface 10 from intermediate surface 14 sufficiently far to stabilize a small barrel of beer when placed in a device. In a preferred embodiment, a large barrel of beer will fit within inner diameter 120 of upper insert and rest on top of lower insert 119. By molding these inserts directly into the device, or by subsequently adding these inserts to the device and affixing them in any suitable manner, such as by gluing them into position, the device can be further lightened by minimizing material.

Figure 7:
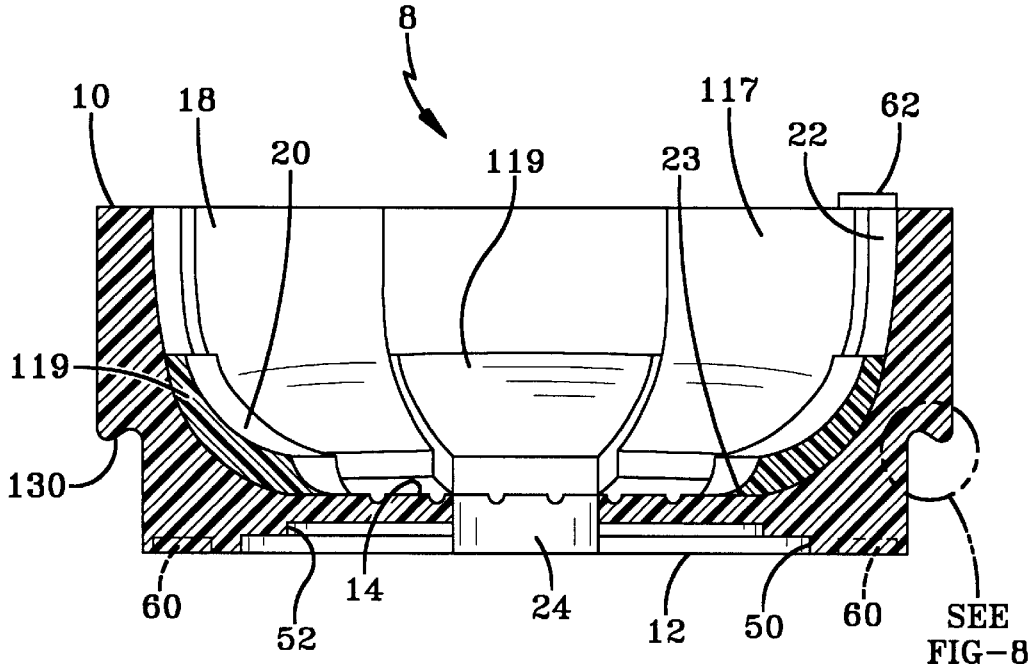
FIG. 7 is a cross-sectional view of a preferred embodiment of the device of the present invention taken in the direction shown in FIG. 6.

Referring now to FIG. 7, the device is provided with indentations 130 for grasping the device so that it can readily lifted when a filled container is within the device. Indentation 130 forms a hand-like grasp, but unlike indentation 30, indentation 130 extends down to bottom surface 12 along a diameter 134 that is smaller than diameter 132 further minimizing the material used in the device, and lightening the device. The indentations can partly span the perimeter as shown in FIG. 1 and extend downward to bottom surface 12. However, the indentations forming the lifting handle can extend completely around the outer perimeter of the device, further lightening the device, provided that the complete extension of the lifting handles downward with reduced diameter 134 do not weaken the device.

Figure 8:
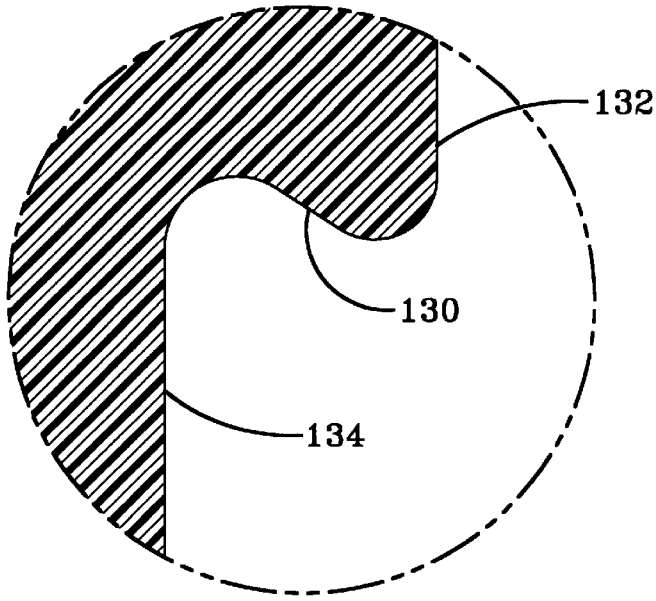
FIG. 8 is an enlarged view of the handle in the preferred embodiment of the present invention.

FIG. 8 shows an enlarged view of indentation on 130 forming a handle that extends downward to the bottom surface 12 of the device, diameter 134 being smaller than diameter 132 along the outer perimeter of device 8.

As has already been described, the device can be utilized to store and to handle either a small keg of beer or a large keg of beer. However, an additional advantage of the device is that it can be used as a table. Once the barrel has been transported to its destination, the barrel can be removed from the device. The device can now be turned over, and the device can be placed over the top of the barrel, barrels typically being symmetric about a plane that is perpendicular to the axis through the center of the barrel. Once the shipping device has been flipped over top of the barrel, a device for withdrawing the contents of the barrel, such as a tap, can be inserted downward through aperture 24, which aperture provides access to the top of the barrel as previously discussed. Thus, the tap is centered over a barrel, regardless of its size. After the barrel has been tapped, the device can act as a table. Apertures 60 can serve as cup holders to hold the cups containing the withdrawn contents of the barrel upon removal through the tap.

Thus, the device of the present invention provides the advantage of not only being an aid in handling heavy barrels such as a barrel of beer, but also providing stability to the barrel in transit. It has been discovered that in the preferred embodiment, when the device is in the form of a square, so that sides 16 are appropriately equal, the shipping device provides a very stable platform for moving even a large barrel or half keg of beer when sides 16 are of a preselected height that is about ⅓ to about ⅕ the height of the cylindrical container being transported. When the cylindrical container is a half keg of beer, this height of the barrel about 22 " and the height of the device is between about 4" to about 7.3", and preferably about 6". Furthermore, when the ratio between any one of the sides 16 to the preselected height of the device, the height being measured from the top surface 10 to the bottom surface 12, wherein the ratio is from about 3-1 to about 4-1, the stability of the device is such that the container cannot readily be tipped. The preferred length of the sides is from about 16" to about 24", and preferably about 18", the diameter of a large barrel of beer being about 15" at diameter 22 along top surface 10 and about 11" at diameter 20 along inner perimeter 18.

The device of the present invention not only provides a stable method of transporting a container such as a barrel of beer, but also provides a convenient means of lifting the barrel of beer. For storage, the device permits for added stability when stacking one barrel directly over another barrel, both barrels being in a vertical position. Furthermore, the present invention allows the devices to be stacked in a stable manner one on top of the other when not in use so that the devices do not slide apart. For a large barrel of beer having the above-stated dimensions, placed in a device having four sides having a length of about 18", and a height between top surface 10 and bottom surface 12 of about 6", experimentation has shown that it takes about 2.9 times more force to tip the barrel along a side, and about 4.7 times more force to tip the barrel along an intersection of any two sides 16, that is to say, along a diagonal than without a device.

Finally, upon reaching the appropriate destination, the device can be flipped over and can act as a table to facilitate the gradual emptying of the contents of the container. If desired, the device can be flipped over and instead of being used as a table, can accept the container or a barrel, thereby providing a stable base while the contents of the container are gradually drawn down.

Figure 9:
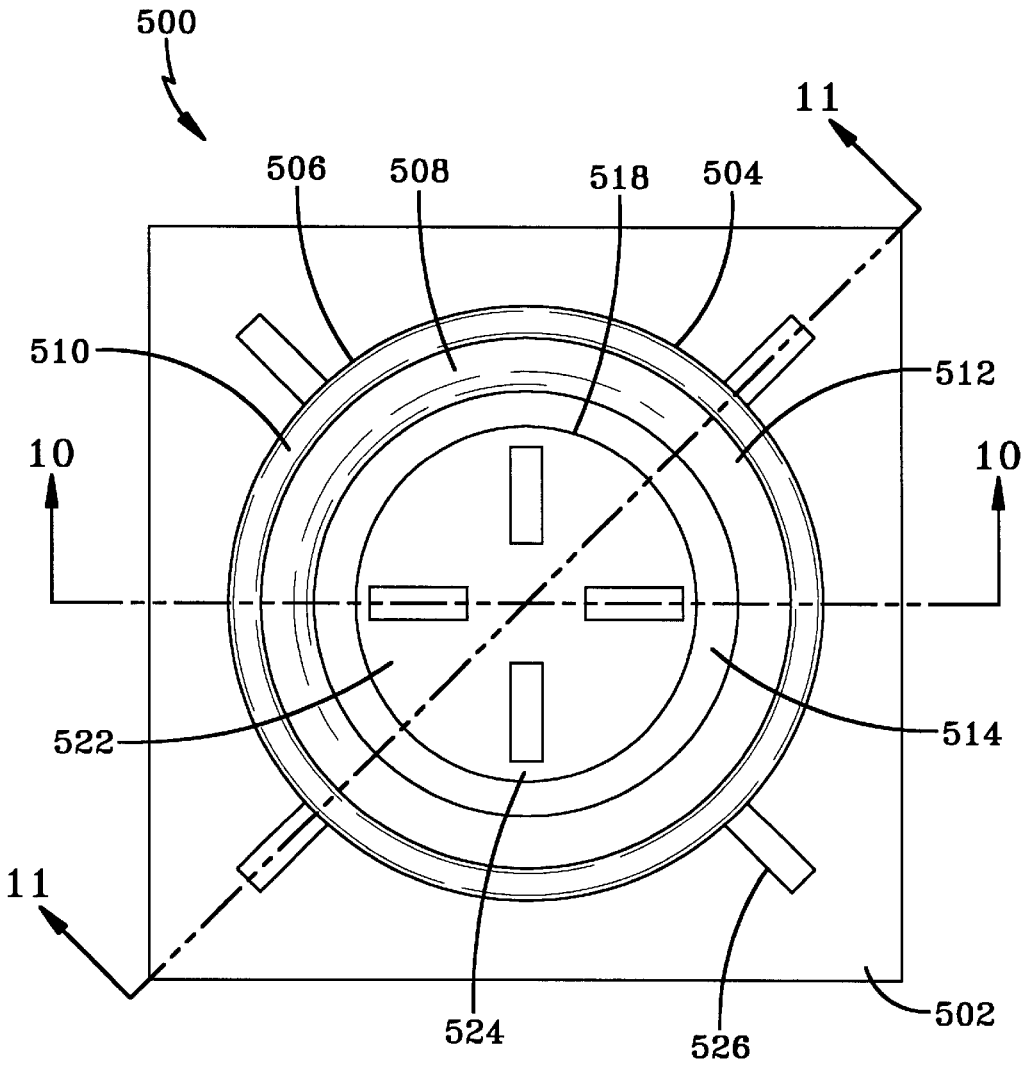
FIG. 9 is a top view of another preferred embodiment of the present invention.
Figure 10:
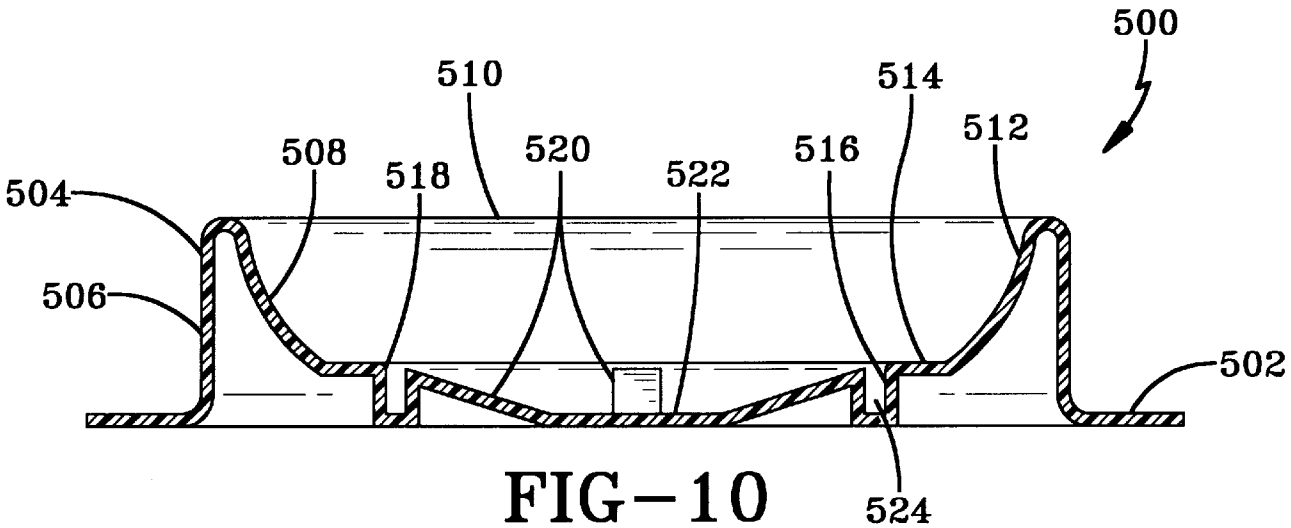
FIG. 10 is a cross-sectional view of the preferred embodiment of FIG. 9 taken in the direction shown in FIG. 9.
Figure 11:
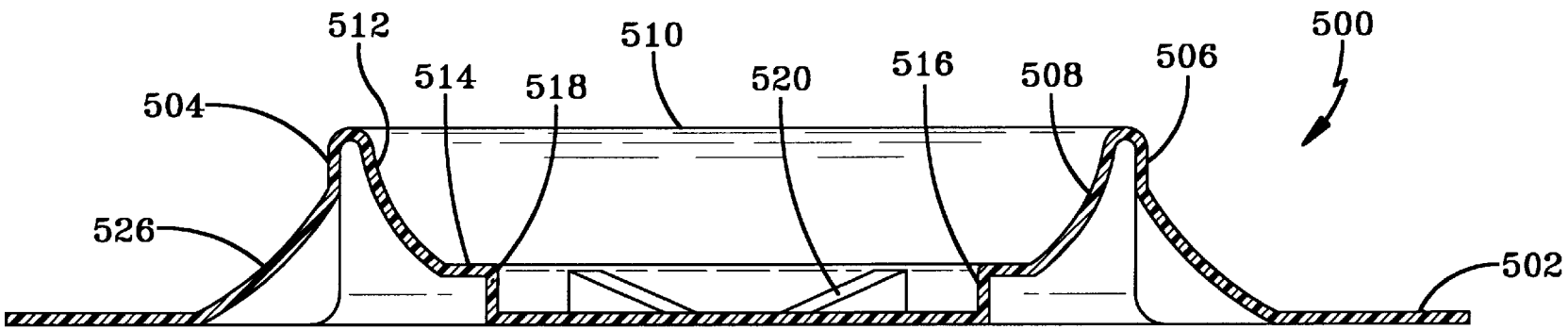
FIG. 11 is a cross-sectional view of the preferred embodiment of FIG. 9 taken in the direction shown in FIG. 9.

Referring now to FIGS. 9, 10 and 11, which are illustrations of the top view, the cross-sectional view taken along line 10—10 in FIG. 9 and the cross-sectional view taken along line 11—11 of FIG. 9 respectively, of another embodiment of a transporting or shipping device 500 of the present invention. The transporting device 500 has a base surface 502. The base surface 502 is preferably shaped as a square as shown in FIG. 9, but can be shaped as a rectangle, circle, oval or any other similar type shape.

Extending from the base surface 502 is a substantially upright projection 504, which, in a preferred embodiment, is cylindrical. The upright projection 504 has an outer surface 506 and an inner surface 508. The outer surface 506 is preferably in the shape of a cylinder, but can also be in the shape of a prism with a base of three sides, four sides or any other number of sides. The inner surface 508 is a surface of revolution having a substantially circular cross-section that is generated by rotating a radius or several radii about a central axis. In addition, the upright projection 504 extends to a top surface 510 which connects the outer surface 506 and the inner surface 508. The top surface 510 can preferably be a curved surface to permit easy loading of the containers to be transported (beer kegs and propane tanks). However, the top surface 510 can also be a flat or squared surface or an angled or pointed surface. The outer surface 506 is preferably substantially perpendicular to the base surface 502. However, for manufacturing purposes, the outer surface 506 may deviate from a right angle by a small amount, up to about 10 degrees, for ease of manufacturing. Such a drafting angle assists in removal from molds when the device 500 is manufactured such as by a molding operation.

Figure 12:
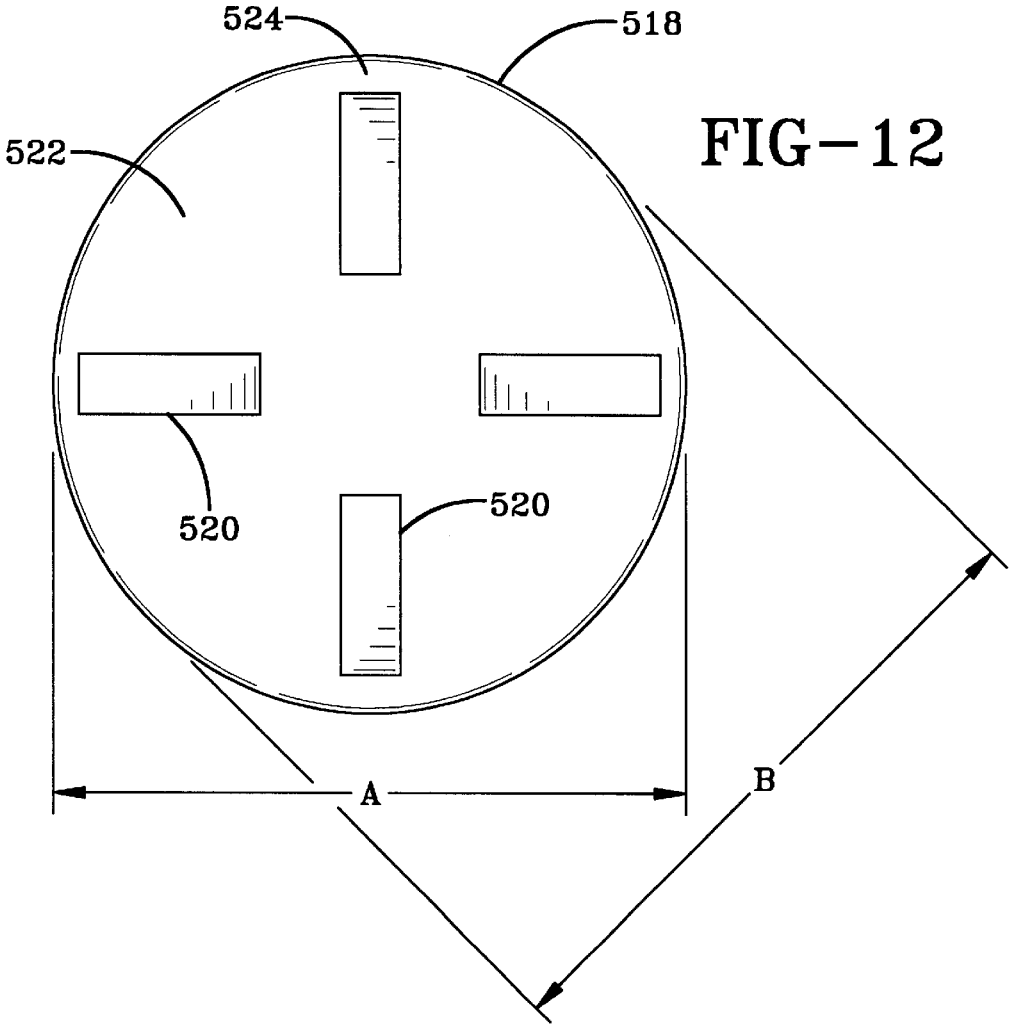
FIG. 12 is an enlarged view of an inner edge of the preferred embodiment of FIG. 9.

The inner surface 508 is a continuous surface extending from the top surface 510 to the base surface 502. The continuous surface of the inner surface 508 can have at least three distinct surfaces that are all coaxial with one another about a central axis and coaxial with the central axis of the upright projection 504, when the upright projection 504 is cylindrical. The inner surface 508 has a first surface 512 (see FIGS. 10 and 11) that extends from the top surface 510 towards the base surface 502. The first surface 512 is a surface of revolution about the central axis having decreasing radii. In other words, the first surface 512 is an arcuate surface that is a substantially bowl-shaped or concave to provide a cavity or opening in the upright projection 504. The cavity or opening in the upright projection 504 can preferably have a diameter of sufficient breadth to receive both a beer keg and a propane tank with only small gap between the beer keg or propane tank and the inner surface 508 being present. The inner surface 508 also has a second surface 514 that is ring-shaped and substantially parallel to the base surface 502. The ring-shaped second surface 514 can preferably have a width of sufficient breadth to support and hold the bottom of a beer keg or propane tank. The arcuate first surface 512 can smoothly transition into the ring-shaped surface 514 or the arcuate surface 512 can abruptly transition into the ring-shaped surface 514. The ring-shaped surface 514 preferably has an elliptical inner edge 518, but the inner edge 518 can also be circular. FIG. 12 shows a magnified top view of the elliptical inner edge 518.

As can be seen from FIG. 12, the diameter of the elliptical inner edge 518 measured at B is slightly larger than the diameter of the elliptical inner edge 518 measured at A. In a preferred embodiment of the present invention, the diameter B is typically between 0.125 to 0.5 of an inch larger than diameter A. Furthermore, in a preferred embodiment, diameter A is about 8 inches and diameter B is about 8.25 inches. The elliptical inner edge 518 has an elliptical shape to be able to accommodate slight deviations in the outer circumference of the bottom support rings of propane tanks. Finally, the inner surface 508 has a third surface 516 that extends from the inner edge 518 to the base surface 502 and is substantially perpendicular to the base surface 502. In a preferred embodiment of the present invention, the height of the third surface 516 of the inner surface 508 is between about 0.5 and 1.25 inches. Preferably, the height of the third surface 516 of the inner surface 508 is 0.75 of an inch.

Figure 13:
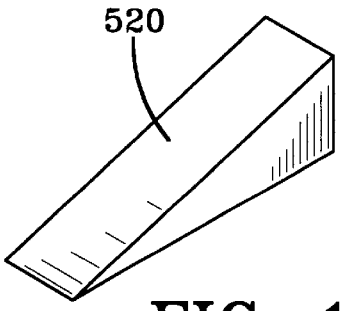
FIG. 13 is an enlarged view of the wedge-shaped projection of the preferred embodiment of FIG. 9.

In addition, several projections 520 can extend radially about the axis of the upright projection 504 in an elliptical area 522 of the base surface 502, i.e. the area of the base surface 502 inside the upright projection 504 and having substantially the same shape as the inner edge 518 of the ring-shaped surface 514. As illustrated in FIG. 9, the projections preferably positioned equidistant from one another, about 90 degrees apart, around the circumference of the elliptical area 522. In other words the projections 520 are positioned symmetrically in the elliptical area 522 to face the perpendicular surface 516. The projections 520 can have a maximum height that is equal to the height of the perpendicular surface 516. However, the height of the projections 520 is preferably less than the height of perpendicular surface 516. The projections 520 are preferably wedge shaped, as shown in FIG. 13, but can also be square or rectangular shaped. The wedge shaped projections 520 preferably start near the center or axis of the elliptical area 522 and increase in height as they near the perpendicular surface 516. In a preferred embodiment of the present invention, the height of the wedge-shaped projections 520 near the perpendicular surface 516 is between about 0.25 and 0.75 of an inch. Preferably, the height of the wedge-shaped projections is 0.375 of an inch. The wedge shaped projections 520 do not extend completely to the perpendicular surface 516, thereby forming a small space or gap 524 between the end of the wedge shaped projection 520 and the perpendicular surface 516. The gap 524 is preferably dimensioned to be able receive a base support ring of a propane tank. In a preferred embodiment of the present invention, the width of the gap is between about 0.25 and 0.75 of an inch. Preferably, the width of the gap is 0.375 of an inch.

The wedge shaped projections 520 are used to retain the propane tank and prevent the propane tank from tipping over as the propane tank is placed in the transporting device 500. FIGS. 9 and 12 show the use of four wedge shaped projections 520, however a minimum of three wedge shaped projections 520, spaced about 120 degrees apart, can be used. In addition, the number of wedge shaped projections 520 projecting from elliptical area 522 can also be greater than four. In another embodiment of the present invention, the shape of the wedge shaped projection 520 could be expanded about the circumference of the elliptical area 522 to form a single inverted-cone like projection. In still a further embodiment of the present invention, the wedge shaped projections 520 could be replaced by a cylindrical projection in the center of the elliptical area 522.

Figure 14:
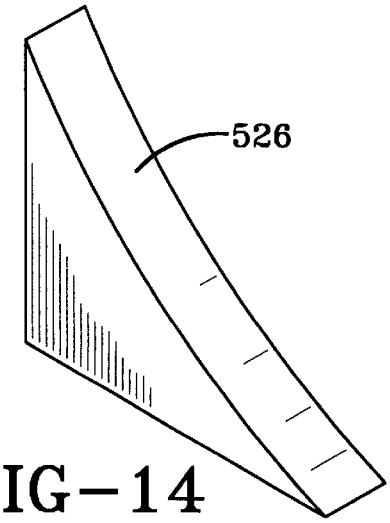
FIG. 14 is an enlarged view of the ribs of the preferred embodiment of FIG. 9.

There is also several supporting ribs 526 that are molded into the outer surface 506 of the upright projection 504. The supporting ribs 526 are preferably used for providing extra stability to the upright projection 504 to aid in the retaining of beer kegs and propane tanks in the upright projection 504. The supporting ribs 526 are also used to prevent any folding of the base surface 502. The supporting ribs 526 are generally wedge shaped as shown in FIG. 14, however, the supporting ribs could also be rectangular in shape. In addition, in a preferred embodiment of the invention the angled surface of the supporting rib 526 could also have a slight curve to it to aid in the removal of the transporting device 500 from a mold. FIG. 9 shows the use of four supporting ribs 526 to support the upright projection 504, however, more or less supporting ribs could be used.

In another embodiment of the present invention, the transporting device 500 could include handles or other suitable arrangements for lifting the transporting device. The handles could be molded or attached to the outer surface 506 of the upright projection 504, preferably diametrically opposed, and can be used as hand-holds for lifting the transporting device 500. However, the handles could also be molded or attached to the base surface 502 of the transporting device 500. The handles could be formed by molding several openings, preferably diametrically opposed, in the base surface 502 to functions as hand-holds for lifting the transporting device 500. In addition, projections could be molded or attached to the base surface 502 to operate as hand-holds for lifting the transporting device 500.

The transporting device 500 should be made as light as possible. It would not be desirable for the transporting device 500 to be heavy, since its purpose is to be an aid in moving a full heavy container as well as in providing stability while the container is being transported. The transporting device 500 is desirably manufactured of a lightweight, moldable material such as a thermoplastic. While any thermoplastic material may be used, preferably, the transporting device 500 is manufactured from acrylonitrile-butadiene-styrene (ABS) or polypropylene, by a process such as injection molding. Most preferably, the device is manufactured by vacuum formed molding. The device can also be manufactured by blow molding or rotational molding. However, the transporting device 500 need not be so restricted; it may also be constructed from composite materials or even graphite. The major drawbacks to such materials is their cost, such materials being prohibitively expensive at this time and complexity in manufacturing.

As illustrated in FIGS. 10 and 11, the bottom of the transporting device 500 has a shape that directly corresponds to the surfaces and projections located on the top of the transporting device 500. In other words, the lightweight, moldable material that is used for manufacturing the transporting device 500 has a uniform thickness over the entire surface of the transporting device 500. The upright projections when viewed from the bottom are apertures. In a preferred embodiment of the present invention, the thickness of the material of the transporting device is between 0.1 and 0.3 of an inch and preferably is 0.125 of an inch. The apertures in the bottom of the transporting device 500 having a uniform thickness can permit several transporting devices 500 to be stacked or nested together in a manner that does not require a lot of space.

In another embodiment, however, the transporting device 500 could have a flat bottom with any spaces between the surfaces and projections on the top of the transporting device 500 being filled with the same material as the transporting device 500. In other embodiments, the bottom of the transporting device 500 could be filled with insulating material or other materials that would provide the transporting device 500 with greater stability and strength.

Thus, the transporting device 500 of the present invention provides the advantage of providing stability to the beer barrel or propane tank as it is being transported. It has been discovered that in the preferred embodiment, when the base surface 502 of the transporting device 500 is in the form of a square, so that the edges of the base surface 502 are appropriately equal, the transporting device 500 provides a very stable platform for moving a beer keg or propane tank when the height of the upright projection 504 is about ⅓ to about ⅕ the height of the cylindrical container being transported. When the cylindrical container is a propane tank, the height of the propane tank is about 17.5 inches and the height of the device is between about 3.5 and 6 inches, and preferably about 4 or 5 inches. Furthermore, when the ratio between the length of any one of the edges of the base surface 502 to the preselected height of the upright projection 504 is from about 3:1 to about 6:1, the stability of the transporting device 500 is such that the container cannot readily be tipped. The preferred length of the edges of the base surface 502 is from about 16 inches to about 24 inches, and preferably about 21.5 inches.

Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

What is claimed is:

1. An apparatus for handling and storing one substantially cylindrical container comprising a molded shipping device and a substantially cylindrical container inserted at least partially in the molded shipping device, the molded shipping device comprising:

a top surface;

a bottom surface;

an intermediate surface positioned between the top and bottom surface, each of the top surface, bottom surface and intermediate surfaces lying in parallel planes;

an outer perimeter having a plurality of sides connecting the top and bottom surfaces, the outer perimeter being substantially at right angles to the planes that include top and bottom surfaces, an arcuate surface connecting the top surface and the intermediate surface, the arcuate surface forming an inner perimeter, the inner perimeter having a first diameter at the intermediate surface and a second diameter at the top surface, the first diameter, the second diameter and inner perimeter being co-axial, the first diameter of the device corresponding to a first diameter of the cylindrical container to be inserted in the molded shipping device and the second diameter of the device corresponding to a second diameter of the cylindrical container to be inserted in the molded shipping device, the second diameter of the device being at least as large as the first diameter of the device, and the second diameter of the device being smaller than the length of any one side of the plurality of sides of the outer perimeter;

an aperture extending between the intermediate surface and the bottom surface, the aperture including at least the center of first diameter; and lifting handles on the outer perimeter for gripping the device, the lifting handles positioned on the outer perimeter substantially opposite one another.

2. The shipping device of claim 1 wherein the bottom surface includes a plurality of cylindrical indentations, the first indentation having a first preselected depth and a first preselected diameter corresponding to a diameter of a first cylindrical container to be inserted in the molded shipping device, each successive indentation having a successive preselected depth greater than the previous preselected depth and a successive preselected diameter less than the first preselected diameter, corresponding to a diameter of a successive cylindrical container to be inserted in the molded shipping device, each successive container to be inserted in the molded shipping device having a smaller diameter than the preceding container, so that a cylindrical container to be inserted in the molded shipping device is captured within at least one cylindrical indentation when the shipping device is inverted and seated over another cylindrical container.

3. The shipping device of claim 2 wherein the bottom surface further includes a plurality of small cavities forming cupholders, each cupholder positioned between the cylindrical indentations and the outer perimeter.

4. The shipping device of claim 3 wherein the top surface includes at least two projections positioned on the top surface to correspond to at least two of the cupholders, each projection sized to be received by the corresponding cupholder so that shipping devices may be stacked in a stable fashion.

5. The shipping device of claim 1 wherein the plurality of sides connecting the top and bottom surfaces are of a preselected height that is about ⅓ to about ⅕ of a height of the cylindrical container to be inserted in the molded shipping device.

6. The shipping device of claim 1 wherein the ratio of a width of the device to a preselected height between the top and bottom of the surfaces is between about 2:1 to about 4:1.

7. The device of claim 1 wherein the lifting handles on the outer perimeter is a single lifting handle extending for 360 degrees along the outer perimeter.

8. A shipping device used for transporting, handling and storing both large and small beer kegs, the shipping device comprising:

a top surface;

a bottom surface;

an intermediate surface positioned between the top surface and the bottom surface, each of the top surface, the bottom surface and intermediate surface lying in parallel planes;

four sides connecting the top and bottom surfaces, the sides lying in planes substantially at right angles to the planes that include top and bottom surfaces, the sides forming an outer perimeter and being of substantially equal length;

an arcuate surface connecting the top surface and the intermediate surface, the arcuate surface forming an inner perimeter which is a concavity between the top surface and the intermediate surface, the inner perimeter having a first diameter at the intermediate surface and a second diameter at the top surface larger than the first diameter, the inner perimeter and the first diameter forming boundaries of a cavity in the device for receiving the beer keg;

an aperture extending between the intermediate surface and the bottom surface;

at least two hand grips in the form of indentations formed in on opposed sides for gripping the device;

the bottom surface of the device further including at least two selectable cylindrical indentations, the first indentation having a diameter and a preselected depth sufficient to permit the device to be placed over the top of a large beer keg in a stable manner, and a second indentation having a diameter and a preselected depth sufficient to permit the device to be placed over the top of a small beer keg in a stable manner;

the bottom surface further including a plurality of small cavities of a size sufficient to hold a cup when the device is placed over the beer keg so that the cavity for receiving the beer keg is placed over the top of the beer keg, and the aperture extending between the intermediate surface and the bottom surface positioned over the keg to permit insertion of a tap into the keg through the aperture.

9. The device of claim 8 wherein the shipping device is constructed of a lightweight, moldable material.

10. The device of claim 8 wherein the shipping device is constructed of a thermoplastic material.

11. The device of claim 8 wherein the sides connecting the top and bottom surfaces are of a preselected height that is about 4 inches to 7.3 inches.

12. The device of claim 8 wherein the length of the sides is greater than 15 inches and the ratio of the length of any one side to the height of the side is about 3:1 to 4:1.

13. The device of claim 8 further including ribs located on at least one surface selected from the bottom surface, the intermediate surface, the inner perimeter and the outer perimeter.

14. A shipping device used for transporting, handling and storing both large and small beer kegs, comprising:

a top surface;

a bottom surface;

four sides connecting the top and bottom surfaces, the sides lying in planes substantially at right angles to the planes that include top and bottom surfaces, the sides forming an outer perimeter and being of substantially equal length and having a preselected height;

an upper intermediate surface positioned between the top surface and the bottom surface, each of the top surface, the bottom surface and the upper intermediate surface lying in parallel planes, the upper intermediate surface including a first aperture for receiving a small beer keg and a ledge lying in the plane of the upper intermediate surface;

a lower intermediate surface positioned between the upper intermediate surface and the bottom surface, each of the upper intermediate surface, the lower intermediate surface and the bottom surface lying in parallel planes;

a first arcuate surface connecting the top surface and the upper intermediate surface, the first arcuate surface forming a first inner perimeter, the first inner perimeter having a first diameter at the upper intermediate surface, the ledge extending inward from the first diameter to the first aperture, and a second diameter at the top surface larger than the first diameter, the first inner perimeter, the ledge terminating at the first aperture and the first diameter forming boundaries of an upper cavity in the device for receiving a large beer keg;

a second arcuate surface connecting the ledge in the upper intermediate surface and the lower intermediate surface, the second arcuate surface forming a second inner perimeter, the second inner perimeter having a diameter at the first aperture of the upper intermediate surface and a third diameter at the lower intermediate surface smaller than the diameter at the first aperture, the second inner perimeter, and the third diameter forming boundaries of lower cavity in the device for receiving a small beer keg, the lower cavity and the upper cavity being coaxial;

an aperture extending between the lower intermediate surface and the bottom surface;

at least two hand grips in the form of indentations formed in each of two opposed sides for gripping the device.

15. The device of claim 14 wherein the shipping device is constructed of a lightweight, moldable material.

16. The shipping device of claim 14 wherein the device is constructed of a thermoplastic material.

17. The shipping device of claim 16 wherein the device is constructed by injection molding the thermoplastic material.

18. The device of claim 17 wherein the device is constructed by rotationally molding polypropylene.

19. The shipping device of claim 16 wherein the device is constructed of polypropylene.

20. The device of claim 14 wherein the sides connecting the top and bottom surfaces are of a preselected height that is about 4 inches to 7.3 inches.

21. An apparatus for transporting, handling and storing one substantially cylindrical container, said apparatus comprising a molded shipping device and a substantially cylindrical container to be inserted in said molded shipping device, said molded shipping device comprising:

a base surface;

a substantially cylindrical projection extending from said base surface and having an axis;

said substantially cylindrical projection comprising a top surface positioned opposite said base surface, an inner wall and an outer wall, said inner wall and said outer wall each connecting said top surface of said substantially cylindrical projection and said base surface;

said inner wall comprising a first surface, a second surface and a third surface, each surface being coaxial with the axis of said substantially cylindrical projection;

said first surface of said inner wall being an arcuate surface and extending between said top surface of said substantially cylindrical projection and said second surface of said inner wall, said first surface of said inner wall having a first diameter at said top surface and a second diameter at said second surface, said first diameter corresponding to a first diameter of the substantially cylindrical container to be inserted in the molded shipping device and said second diameter corresponding to a second diameter of the substantially cylindrical container to be inserted in the molded shipping device, and said first diameter being larger than said second diameter;

said second surface of said inner wall being substantially parallel to said base surface and extending between said first surface and said third surface of said inner wall, said second surface of inner wall being positioned to support a portion of the substantially cylindrical container to be inserted into said molded shipping device;

said third surface of said inner wall being positioned between said base surface and said second surface of said inner wall, said third surface being substantially perpendicular to said base surface and having an elliptical cross-section;

a plurality of projections extending from said base surface and being positioned radially about the axis of the substantially cylindrical projection, each of said plurality of projections comprising a first end adjacent said third surface of said inner wall and a second end positioned opposite said first end adjacent the axis of cylindrical projection; and each first end of said plurality of projections being positioned a distance from said third surface to form a space between each of said plurality of projections and said third surface of said inner wall.

22. The apparatus of claim 21 wherein the substantially cylindrical container to be inserted in the molded shipping device comprises a projection extending from the portion of the substantially cylindrical container supported by said second surface of said inner wall and said space between each of said plurality of projections and said third surface of said inner wall being configured to receive the projection.

23. The apparatus of claim 21 wherein said outer wall comprises at least one rib extending from said outer wall.

24. The apparatus of claim 23 wherein the outer wall comprises a plurality of ribs extending from said outer wall and positioned radially about the axis of said substantially cylindrical projection.

25. The apparatus of claim 21 wherein the molded shipping device further comprises means for lifting the molded shipping device.

26. The apparatus of claim 21 wherein each of said plurality of projections is substantially wedge-shaped and the first end of each of said plurality of projections has a height less than a height of said third surface of said inner wall and the second end of each of said plurality of projections has a height substantially smaller than the height of said first end.

27. The apparatus of claim 21 wherein said inner wall and said outer wall are of a preselected height that is about ⅓ to about ⅕ of a height of the substantially cylindrical container to be inserted in said molded shipping device.

28. The apparatus of claim 21 wherein said base surface is substantially in the shape of a square and the ratio of a width of said base surface to a preselected height of said inner wall and said outer wall is between about 3:1 to about 6:1.

29. The apparatus of claim 21 wherein the molded shipping device is manufactured from an acrylonitrile-butadiene-styrene (ABS) thermoplastic.

30. A shipping device used for transporting, handling and storing one of a beer keg and propane tank, the shipping device comprising:

a base surface;

a substantially cylindrical projection extending from said base surface and having an axis;

said substantially cylindrical projection comprising a top surface disposed opposite said base surface, an inner perimeter and an outer perimeter, each of said inner perimeter and said outer perimeter connecting said top surface of said substantially cylindrical projection and said base surface;

said inner perimeter comprising a first surface, a second surface and a third surface, each surface being coaxial with the axis of said substantially cylindrical projection;

said first surface of said inner perimeter being an arcuate surface and extending between said top surface of said substantially cylindrical projection and said second surface of said inner perimeter, said first surface of said inner perimeter having a first diameter at said top surface and a second diameter at said second surface of said inner perimeter, and said first diameter of said first surface being larger than said second diameter of said first surface;

said second surface of said inner perimeter being substantially parallel to said base surface and extending between said first surface and said third surface of said inner perimeter;

said first surface and said second surface of inner perimeter being positioned to receive one of a propane tank and a beer keg;

said third surface of said inner perimeter being positioned between said base surface and said second surface of said inner perimeter, said third surface being substantially perpendicular to said base surface and having an elliptical cross-section;

a plurality of wedge-shaped projections extending from said base surface and being positioned radially about the axis of the substantially cylindrical projection, each of said plurality of wedge-shaped projections comprising a first end adjacent said third surface of said inner perimeter and a second end positioned opposite said first end adjacent the axis of cylindrical projection;

each of said plurality of wedge-shaped projection being disposed a distance from said third surface to form a gap between each said plurality of wedge-shaped projections and said third surface of said inner perimeter; and said gap between each of said wedge-shaped projections and said third surface of said inner wall being positioned to receive a base ring of a propane tank.

31. The shipping device of claim 30 wherein the shipping device is constructed of a thermoplastic material.

32. The shipping device of claim 31 wherein the shipping device is constructed by using an injection molding technique on the thermoplastic material.

33. The shipping device of claim 32 wherein the thermoplastic material comprises one of polypropylene and acrylonitrile-butadiene-styrene (ABS) and the injection molding technique comprises one of vacuum formed molding and rotational molding.

34. The shipping device of claim 30 wherein the shipping device is constructed of acrylonitrile-butadiene-styrene (ABS).

35. The shipping device of claim 34 wherein the device is constructed by vacuum formed molding the acrylonitrile-butadiene-styrene (ABS).

36. The shipping device of claim 30 wherein said outer perimeter comprises at least one rib extending from said outer perimeter.

37. The shipping device of claim 36 wherein the outer perimeter comprises a plurality of ribs extending from said outer perimeter and positioned radially about the axis of said substantially cylindrical projection.

38. The shipping device of claim 30 further comprises means for lifting the shipping device.

39. The shipping device of claim 30 wherein said inner perimeter and said outer perimeter are of a preselected height that is between about 4 inches and about 6 inches.

40. The shipping device of claim 30 wherein said base surface is substantially in the shape of a square and has a width that is between about 16 inches and about 24 inches.

* * * * *